US008328459B2

(12) United States Patent
Hill

(10) Patent No.: US 8,328,459 B2
(45) Date of Patent: Dec. 11, 2012

(54) COUPLER FOR EXCAVATORS

(76) Inventor: Ian Hill, Newry (GB)

( * ) Notice: Subject to any disclaimer, the term of this patent is extended or adjusted under 35 U.S.C. 154(b) by 181 days.

(21) Appl. No.: 12/440,948

(22) PCT Filed: Sep. 13, 2007

(86) PCT No.: PCT/EP2007/007974
§ 371 (c)(1),
(2), (4) Date: Mar. 12, 2009

(87) PCT Pub. No.: WO2008/031590
PCT Pub. Date: Mar. 20, 2008

(65) Prior Publication Data

US 2010/0067982 A1 Mar. 18, 2010

(30) Foreign Application Priority Data

Sep. 13, 2006 (GB) ..... 0618034.3
Oct. 11, 2006 (GB) ..... 0620139.6
Feb. 7, 2007 (GB) ..... 0702372.4

(51) Int. Cl.
*B25G 3/18* (2006.01)

(52) U.S. Cl. ..... 403/322.4; 403/31; 37/468; 414/723; 172/272

(58) Field of Classification Search ..... 403/322.3, 403/322.4, 321, 31; 37/468; 414/723; 172/272
See application file for complete search history.

(56) References Cited

U.S. PATENT DOCUMENTS 1,085,964 A 2/1914 Briggs
2,056,006 A 9/1936 Hodgkins
2,932,282 A 1/1945 McKinley et al.
2,366,587 A 4/1960 Armington
4,577,885 A * 3/1986 Breu ..... 280/508
(Continued)

FOREIGN PATENT DOCUMENTS

FR 978531 4/1951
(Continued)

OTHER PUBLICATIONS

The International Search Report for PCT Application No. PCT/EP2007/007974, which is the international counterpart to the present application.

(Continued)

*Primary Examiner* — Daniel Stodola
*Assistant Examiner* — Jonathan Masinick
(74) *Attorney, Agent, or Firm* — Gardner, Linn, Burkhart & Flory, LLP

(57) ABSTRACT

A coupler for an excavator, the coupler comprising first and second recesses for receiving the pins of an attachment, a latching hook movable into and out of a latching state in which it closes the second pin-receiving recess, and a blocking bar movable into and out of a blocking state in which a portion of the blocking bar closes the first recess. The arrangement is such that, when the blocking bar is engaged in use by an attachment pin contained within the first recess, the action of the pin on the blocking bar urges the blocking bar into its blocking state. The blocking bar is further arranged so that, in the blocking state, it lies in the path of the latching hook and that, upon movement of the latching hook out of the latching state, the latching hook engages with the blocking bar to retain it in the blocking state.

26 Claims, 19 Drawing Sheets

U.S. PATENT DOCUMENTS

| | | | | |
|---|---|---|---|---|
| 5,423,625 | A | 6/1995 | Gebauer et al. | |
| 6,273,128 | B1 | 8/2001 | Paczonay | |
| 6,379,075 | B1 | 4/2002 | Shamblin et al. | |
| 6,481,124 | B1 | 11/2002 | Miller et al. | |
| 6,902,346 | B2 | 6/2005 | Steig, Jr. et al. | |
| 7,306,395 | B2 | 12/2007 | Fatemi | |
| 7,426,796 | B2 | 9/2008 | Cunningham et al. | |
| 7,493,712 | B2 * | 2/2009 | McCormick et al. | 37/468 |
| 7,549,243 | B1 * | 6/2009 | Gilles | 37/468 |
| 7,648,305 | B2 * | 1/2010 | Beales | 403/322.1 |
| 7,984,575 | B2 | 7/2011 | Robl et al. | |
| 7,984,576 | B2 * | 7/2011 | Miller et al. | 37/468 |
| 2002/0071754 | A1 | 6/2002 | Fatemi | |
| 2004/0255774 | A1 | 12/2004 | Hill | |
| 2005/0169703 | A1 | 8/2005 | Fatemi | |
| 2005/0214105 | A1 * | 9/2005 | Steig et al. | 414/723 |
| 2007/0157492 | A1 | 7/2007 | Miller et al. | |
| 2007/0166143 | A1 * | 7/2007 | Hart et al. | 414/723 |
| 2007/0199214 | A1 * | 8/2007 | McCormick et al. | 37/468 |
| 2009/0282712 | A1 | 11/2009 | Pruszynski | |
| 2010/0061799 | A1 | 3/2010 | Hill | |
| 2011/0088795 | A1 | 4/2011 | Hill | |
| 2011/0091267 | A1 | 4/2011 | Hill | |
| 2011/0243654 | A1 | 10/2011 | Hill | |

FOREIGN PATENT DOCUMENTS

| | | | |
|---|---|---|---|
| FR | 1146273 | | 11/1957 |
| FR | 2914932 | | 10/2008 |
| GB | 897384 | | 5/1962 |
| GB | 1586621 | | 3/1981 |
| GB | 2330570 | | 4/1999 |
| GB | 2332417 | | 6/1999 |
| GB | 2450127 | | 12/2008 |
| JP | 57155168 | | 9/1982 |
| KR | 20010019689 | A | 3/2001 |
| NZ | 220557 | A | 2/1991 |
| WO | WO 98/40569 | | 9/1998 |
| WO | 2005026454 | | 3/2005 |
| WO | WO 2008/031590 | | 3/2008 |
| WO | 2011/035883 | A1 | 3/2011 |

OTHER PUBLICATIONS

The Written Opinion of the International Searching Authority for PCT Application No. PCT/EP2007/007974, which is the international counterpart to the present application.

* cited by examiner

COUPLER FOR EXCAVATORS

CROSS REFERENCE TO RELATED APPLICATIONS

This patent is a national stage filing under 35 U.S.C. §371 of international application Ser. No. PCT/EP2007/007974 filed in the European Receiving Office on Sep. 13, 2007, which claims priority to Great Britain Application No. 0702372.4, filed on Feb. 7, 2007, Great Britain Application No. 0620139.6, filed on Oct. 11, 2006 and Great Britain Application No. 0618034.3, filed on Sep. 13, 2006, the complete disclosures of all of which are hereby incorporated herein by reference.

FIELD OF THE INVENTION

The present invention relates to a coupler for excavators. The invention relates particularly to couplers having power operated latching hooks.

BACKGROUND OF THE INVENTION

It is well known for a coupler to have a hydraulically operated latching hook for engaging with the pins of an attachment, e.g. a bucket, for the arm of an excavator. Such couplers typically include a safety mechanism for preventing the attachment from becoming disengaged from the coupler in the event of hydraulic failure.

It is an object of the present invention to provide an alternative, improved safety mechanism.

SUMMARY OF THE INVENTION

Accordingly, the invention provides a coupler for an excavator, the coupler comprising a body having first and second recesses for receiving first and second pins, respectively, of an attachment; a latching member movable into and out of a latching state in which it at least partially closes said second pin-receiving recess; and a blocking member movable into and out of a blocking state in which a portion of the blocking member at least partially closes said first recess.

Preferably, said portion of the blocking member is shaped so that, when engaged in use by an attachment pin contained within said first recess, the action of the pin on said portion urges said blocking member into its blocking state.

Preferably, the blocking member is arranged so that, in the blocking state, it lies in the path of the latching member and that, upon movement of the latching member out of the latching state, the latching member engages with the blocking member to retain it in the blocking state.

Typically, the latching hook and/or the blocking bar are mounted, more preferably pivotably mounted, on the body.

In the preferred embodiment, a lever is mounted on the body and is movable into and out of a holding state in which it is capable of holding the blocking bar out of the blocking state, the lever being coupled to the latching hook to move into the holding state when the latching hook is moved out of the latching state and to move out of the holding state when the latching hook moves into the latching state.

Preferably, the lever is pivotably mounted on the body at or adjacent the rear of the latching hook. Advantageously, the lever is resiliently biased into contact with the rear of the latching hook.

In the preferred embodiment, the latching hook carries a cam and the lever includes a cooperating ramped cam surface, the cam being arranged to ride along the cam surface as the latching hook moves into and out of its latching state, the cam surface being shaped to cause the angle of inclination between the latching hook and the lever to increase as the hook moves out of the latching state and to decrease as the hook moves into the latching state.

The coupler may include a biasing means, such as a leaf spring, torsion spring or other biasing member, coupled to the blocking bar and arranged to engage with an excavator arm to which the coupler is attached during use depending on the relative orientation of the coupler and the arm, wherein in a first relative orientation of the coupler and the arm, the biasing means is held under tension between the arm and the blocking bar urges the blocking bar into its blocking state. Alternatively, the biasing member may be coupled to the excavator arm and arranged for engagement with the blocking member.

In a preferred embodiment, the biasing means, in the preferred form of a leaf spring, comprises a bent or crank portion located at or near its free end. In use, the end of said crank portion engages the excavator arm in the first relative orientation of the coupler and arm.

Further advantageous aspects of the invention will become apparent to those ordinarily skilled in the art upon review of the following description of a specific embodiment of the invention and with reference to the accompanying drawings

BRIEF DESCRIPTION OF THE DRAWINGS

Embodiments of the invention are now described by way of example and with reference to the accompanying drawings in which like numerals are used to indicate like parts and in which.

DETAILED DESCRIPTION OF THE EMBODIMENTS

Figure 1:
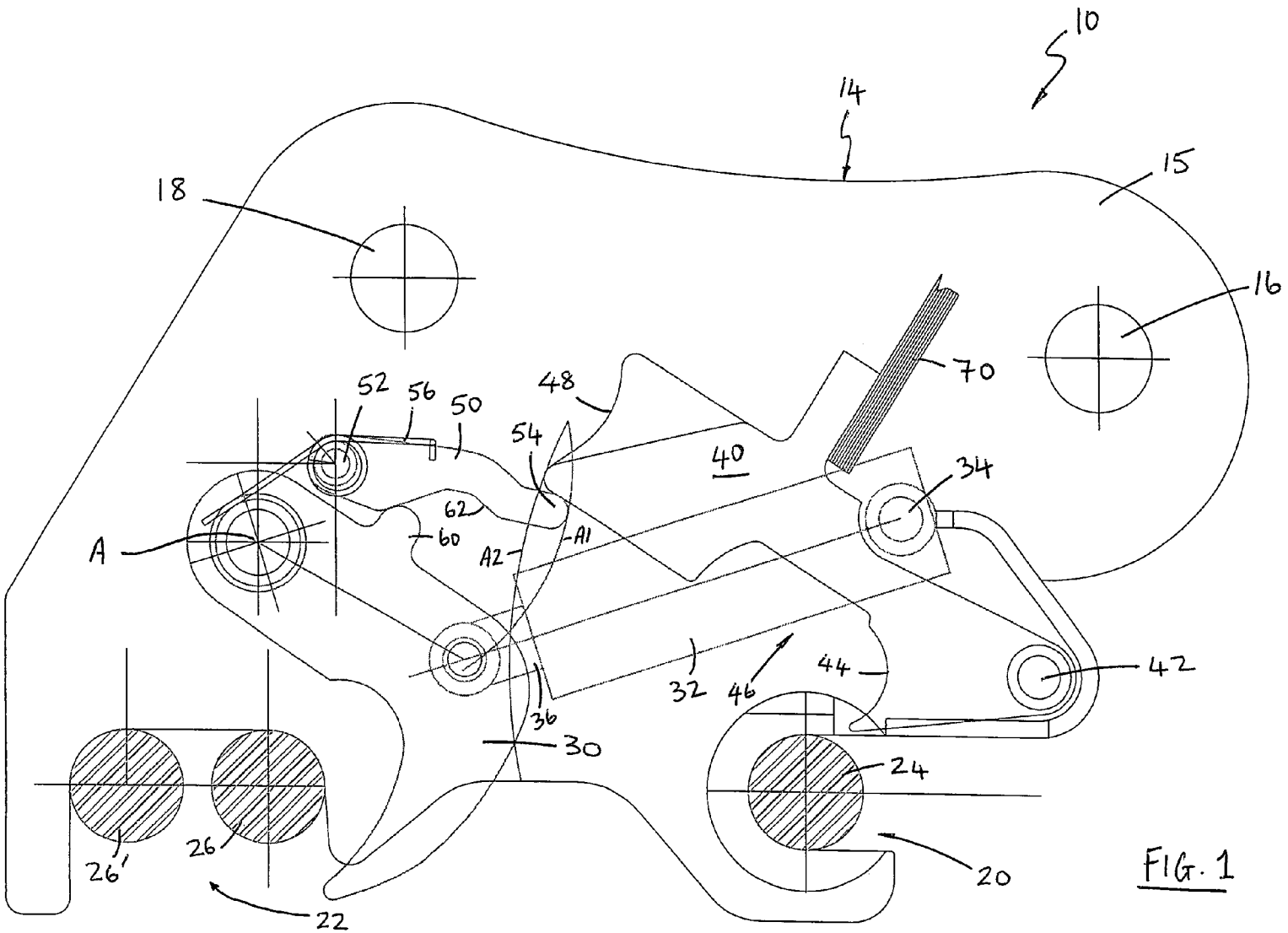
FIG. 1 is a cut-away side view of a coupler embodying the invention, the coupler being shown in a first state of use.

Referring now to the drawings there is shown, generally indicated as 10, a coupler or hitch for connecting a tool or attachment, such as a bucket, to a jib or arm 12 (FIGS. 5 to 16) of an excavator (not shown), or other apparatus. The coupler 10 has a body 14 typically comprising two spaced-apart side plates 15 (only one shown). The body 14 is shaped to define pin-receiving apertures 16, 18 by which the coupler 10 may be connected to the end of the arm 12. Typically, there are two spaced-apart apertures 16, 18 in each of the two side plates 15, the apertures in one side plate being aligned with the apertures in the other. FIGS. 5 to 16 show the coupler 10 connected to the arm 12 at one set of apertures 16 only although in practice the other set of apertures 18 are usually connected to a linkage (not shown) carried by the arm 12. When connected, the coupler 10 is able to pivot with respect to the arm 12 about the axis of the apertures 16, as is apparent by comparing FIGS. 5 to 7. Usually, a hydraulic mechanism, or other power operated mechanism (not shown), is provided to pivot the coupler 10 with respect to the arm 12.

The body 14 includes first and second pin-receiving recesses 20, 22 formed in each side plate 15. Each recess 20, 22 is shaped and dimensioned to receive a respective pin 24, 26 of a bucket or other attachment. Normally, the recesses 20, 22 face in mutually perpendicular directions. The recess 22 may be wider than is necessary to receive a single pin 26 in order to accommodate attachments with different pin spacings, as is illustrated by pin 26'.

The coupler 10 also includes a power-operated latching mechanism typically comprising a latching hook 30 and an actuator 32 typically in the form of a hydraulic ram. Other forms of powered actuator could be used (e.g. pneumatic or electrically operated) but hydraulic is convenient because excavators typically have a hydraulic system available at or near the end of the arm 12. The latching hook 30 and ram 32 are provided between the side plates 15. The latching hook 30, which may comprise one or more aligned hook elements, is pivotably mounted on the body 14 in any convenient manner and is pivotable about an axis A which runs substantially perpendicular to the body 14/plates 15. The hook 30 is pivotable between an open state (shown in FIGS. 1 and 3) and at least one latching state (shown in FIGS. 2 and 4). In the open state, the latching hook 30 allows the pins 26, 26' to be inserted into or removed from the recess 22. In the latched state, the latching hook 30 prevents the pins 26, 26' from being removed from the recess 22. In alternative embodiments, the hook may be slidably mounted on the body, or otherwise movable between the open state and the latching state(s), without necessarily being pivot able.

In the preferred embodiment, the ram 32 has its butt end 34 pivotably mounted on the body 14 and the free end 36 of its piston rod 36 is pivotably connected to the latching hook 30, in each case the pivoting movement being about a respective axis that is substantially perpendicular to the plates 15. When the piston rod 36 adopts a retracted state (FIGS. 1 and 3), the latching hook 30 adopts its open state. When the piston rod 36 is extended, the hook 30 moves towards its latching state. Depending on the location of the pin 26, 26' in the recess 22, the amount by which the piston rod 36 is extended when the hook 30 reaches its latching state can vary, as can be appreciated from a comparison of FIGS. 2 and 4. Conveniently, the ram 32 is operable via the excavator's hydraulic system (not shown), the controls typically being located in the cab of the excavator.

Figure 2:
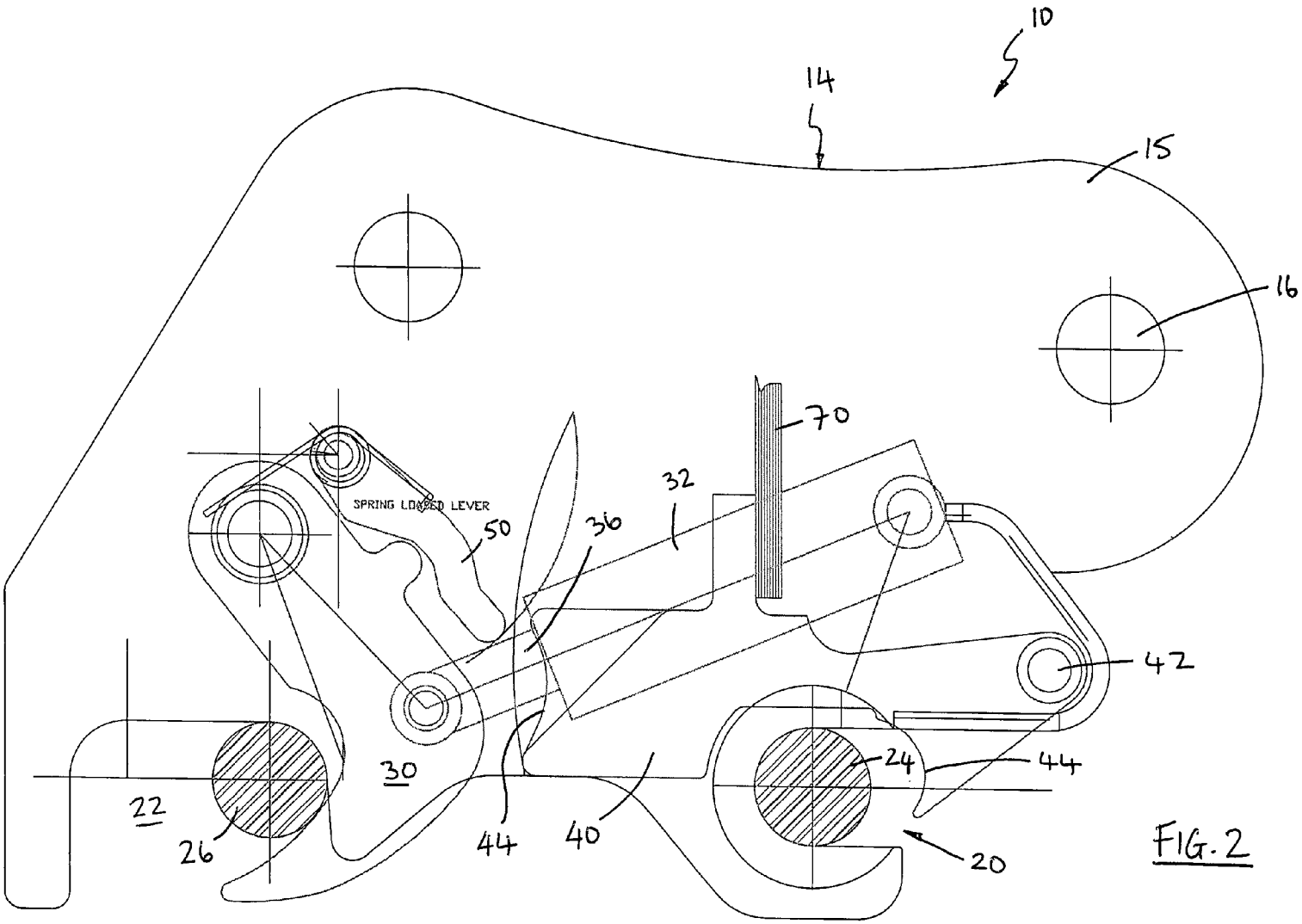
FIG. 2 is a cut-away side view of the coupler of FIG. 1, the coupler being shown in a second state of use connected to an attachment with minimum pin spacing.

The coupler 10 further includes a blocking member in the preferred form of a bar 40 which has one end 42 pivotably mounted on the body 14 in any convenient manner, e.g. pin or bearing. The blocking bar 40 is pivotable about an axis substantially perpendicular to the side plates 15 between a non-blocking state (FIG. 1) and a blocking state (FIG. 2). In the non-blocking state, the blocking bar 40 is clear of the recess 20 and does not prevent the pin 24 from being removed from the recess 20, while in the blocking state, the blocking bar 40 prevents the pin 24 from being removed from the recess 20. In the preferred embodiment, the blocking bar 40 includes a jaw 44 which, in the blocking state, substantially closes the otherwise open mouth of the recess 20. The jaw 44 may form part of a recess 46 provided in the blocking bar 40, which recess 46, in the blocking state, embraces the pin 24 located in the recess 20.

In the preferred arrangement, the end 42 of the blocking bar 40 is pivotably mounted on the body 14 beyond the recess 20 with respect to the latching hook 30. This allows the blocking bar 40 to be shaped and dimensioned so that its other end 48 lies in the path of the latching hook 30 when in the blocking state.

In the preferred embodiment, a lever 50 has one end 52 pivotably mounted on the body 14 and is positioned so that its other end 54 may be located in the path of the blocking bar 40. The lever 50 is movable between a holding state (FIG. 1) in which its end 54 engages with the blocking bar 40 in order to hold the blocking bar 40 in its non-blocking state, and a non-holding state (FIGS. 2 to 4), in which the lever 50 does not interfere with the movement of the blocking bar 40. In the preferred embodiment, the lever 50 is located adjacent the rear of the latching hook 30 and is resiliently biased by a spring 56, or other biasing means, to move towards and into engagement with, the rear of the hook 30. The arrangement is such that movement of the latching hook 30 between its latching and open states causes a corresponding movement of the lever 50. In particular, when the latching hook 30 adopts its open state, the lever 50 adopts its holding state. In the preferred embodiment, the rear of the latching hook 30 carries a cam 60 and the lever 50 includes a cooperating, and preferably ramped, cam surface 62. The cam 60 rides along the cam surface 62 as the latching hook 30 moves between its latching and open states, the cam surface 62 being shaped to cause the angle of inclination between the latching hook 30 and the lever 50 to increase as the hook 30 moves towards the open state and to decrease as the hook 30 moves towards the latching state. This has the effect of pushing the lever 50 away from the rear of the hook 30 as the hook 30 is retracted. Arcs A1 and A2 show the respective paths taken by the lever 50 and the blocking bar 40.

In alternative embodiments (not illustrated), the lever 50 may be independently operated by, for example, a hydraulic ram or other actuator, or may be integrally formed with the latching hook. Alternatively still, the blocking bar 40 may be held in the non-blocking state by the latching hook itself (when retracted) or a projection therefrom.

Figure 4:
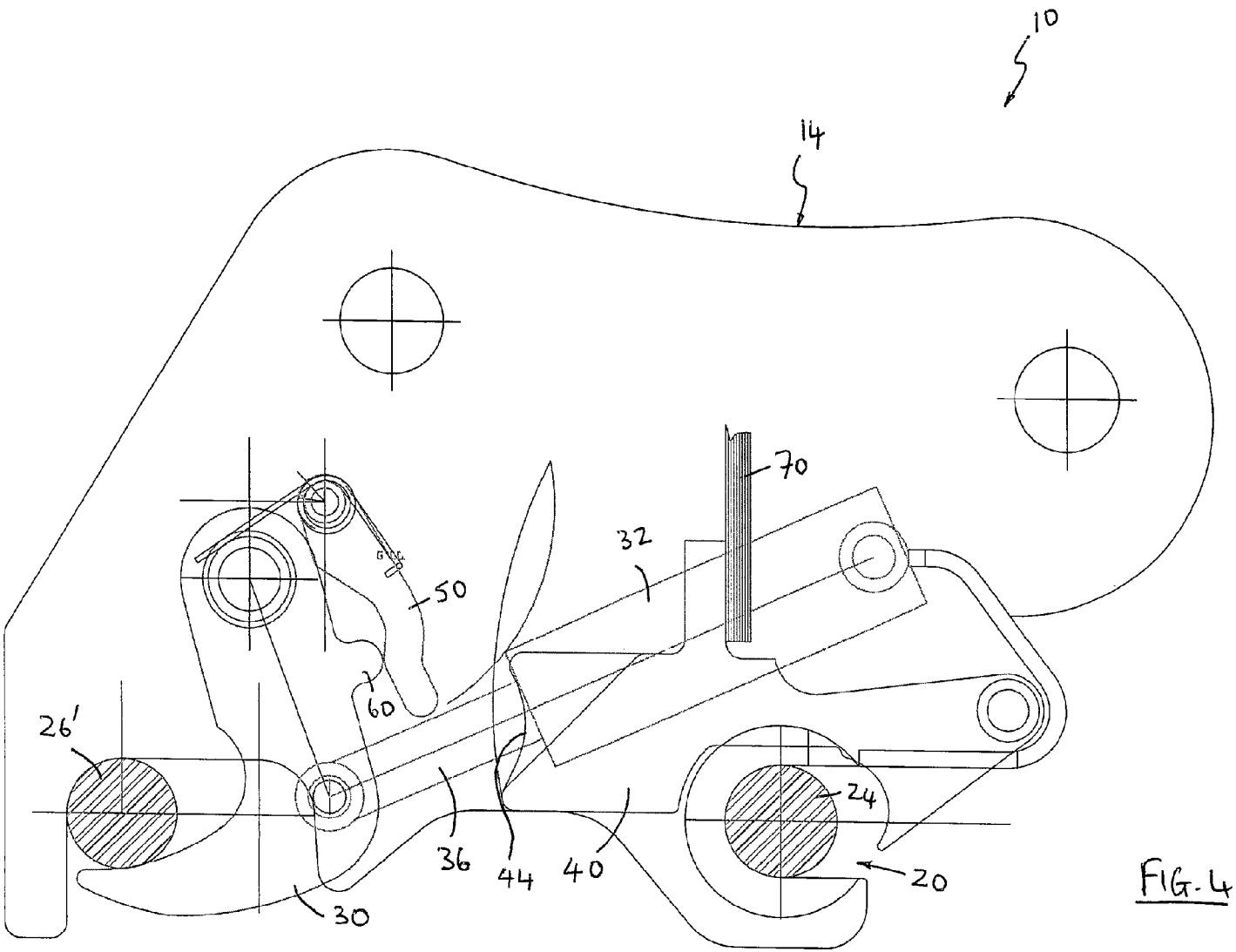
FIG. 4 is a cut-away side view of the coupler of FIG. 1, the coupler being shown in the second state of use but connected to an attachment with maximum pin spacing.

In a first state of use (FIG. 1), the latching hook 30 is open, the blocking bar 40 is in its non-blocking state and is held by the lever 50 which adopts its holding state. In this state of use, the recesses 20, 22 are substantially unobscured and so are ready to receive attachment pins 24, 26, 26'. Normally, an operator (not shown) in the cab of the excavator manoeuvres the coupler 10 to capture the first attachment pin 24 in recess 20 and then rotates the coupler 10 to capture the second pin 26 or 26'. The operator then operates the ram 32 to move the latching hook 30 into its latching state (FIGS. 2 and 4). Movement of the latching hook 30 causes the lever 50 to move out of its holding state which in turn allows the blocking bar 40 to move from the non-blocking state to the blocking state. In the illustrated embodiment, the blocking bar 40 adopts the blocking state under the influence of gravity but, in alternative embodiments (not illustrated) the blocking bar 40 may be resiliently biased by a spring, or other biasing means, to adopt the blocking state, and/or may be power operated by any suitable actuator (e.g. pneumatic, hydraulic or electrical). Hence, FIGS. 2 and 4 show the coupler 10 in a second state of use in which the latching hook 30 holds the pin 26 or 26' in the recess 22, while the blocking bar 40 holds the pin 24 in the recess 20.

Figure 3:
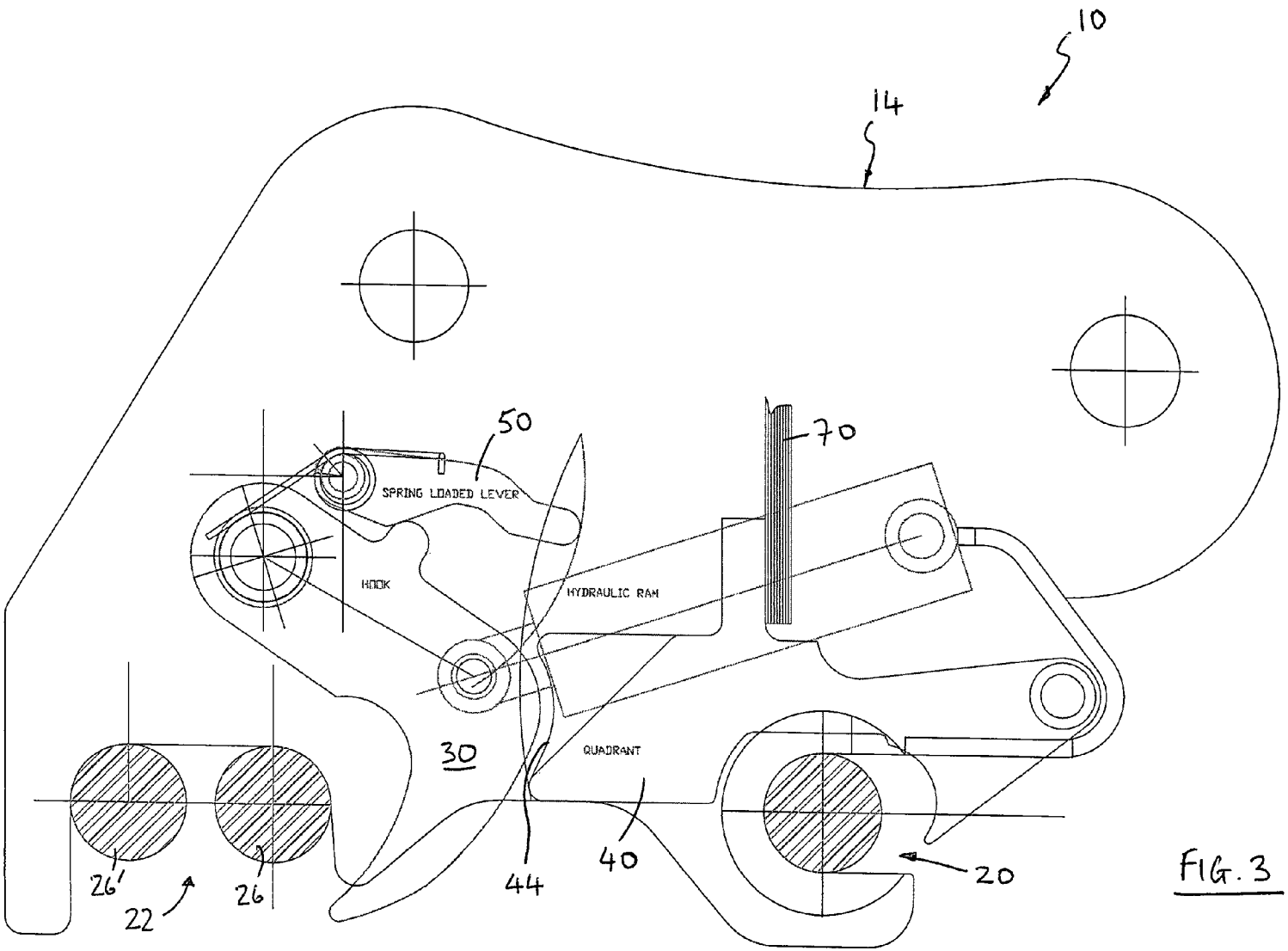
FIG. 3 is a cut-away side view of the coupler of FIG. 1, the coupler being shown in a third state of use.

Should the latching hook 30 retract during use, for example as a result of hydraulic failure of the ram 32 or by operator error, the end 48 of the blocking bar 40 is located in the path of the latching hook 30 such that the latching hook 30 engages with the blocking bar 40 (see FIG. 3, although a small clearance is shown in FIG. 3 for reasons of clarity). This engagement serves to hold the blocking bar 40 in its blocking state. Hence, in a third state of use, the latching hook 30 is in its open state, but retains the blocking bar 40 in its blocking state and so the pin 24 is secured in recess 20 and the attachment cannot disengage from the coupler 10

Figure 5:
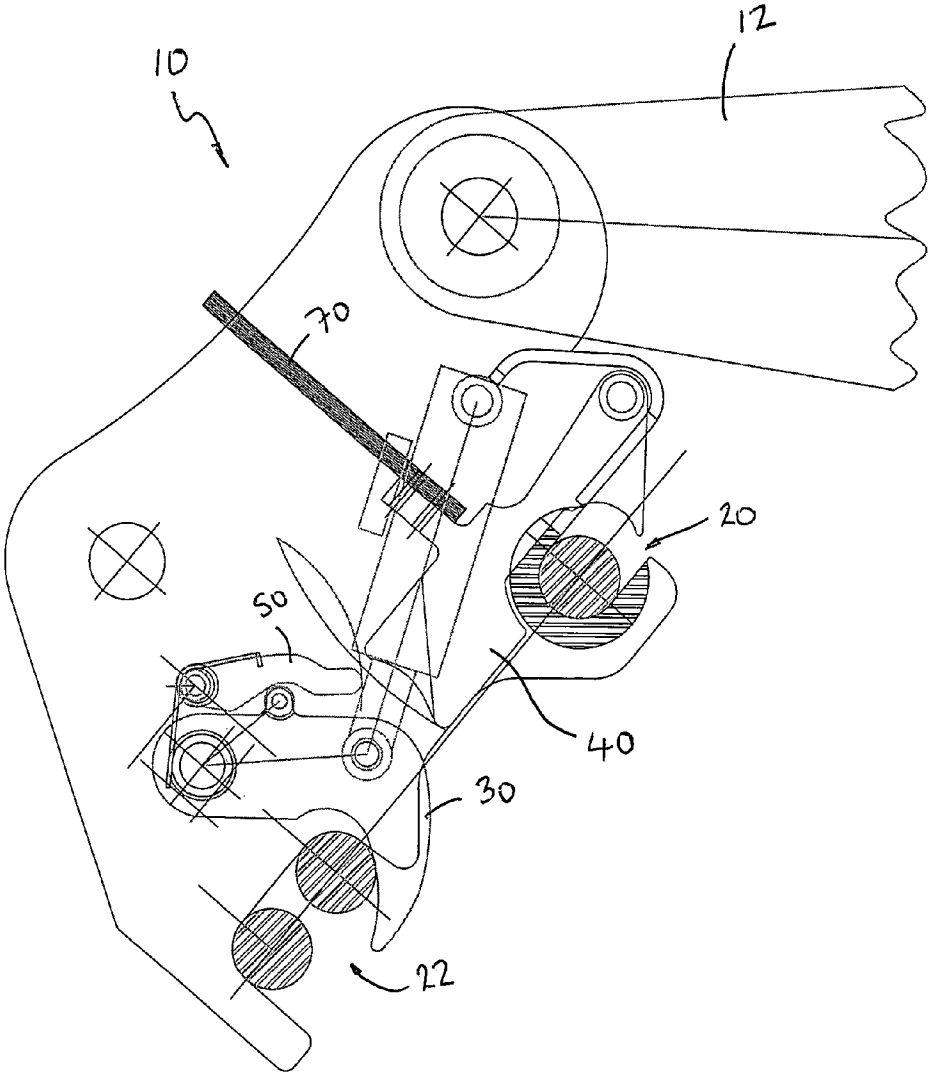
FIG. 5 is a cut-away side view of the coupler of FIG. 1, connected to an excavator arm, the arm and the coupler being shown in a normal working orientation.
Figure 6:
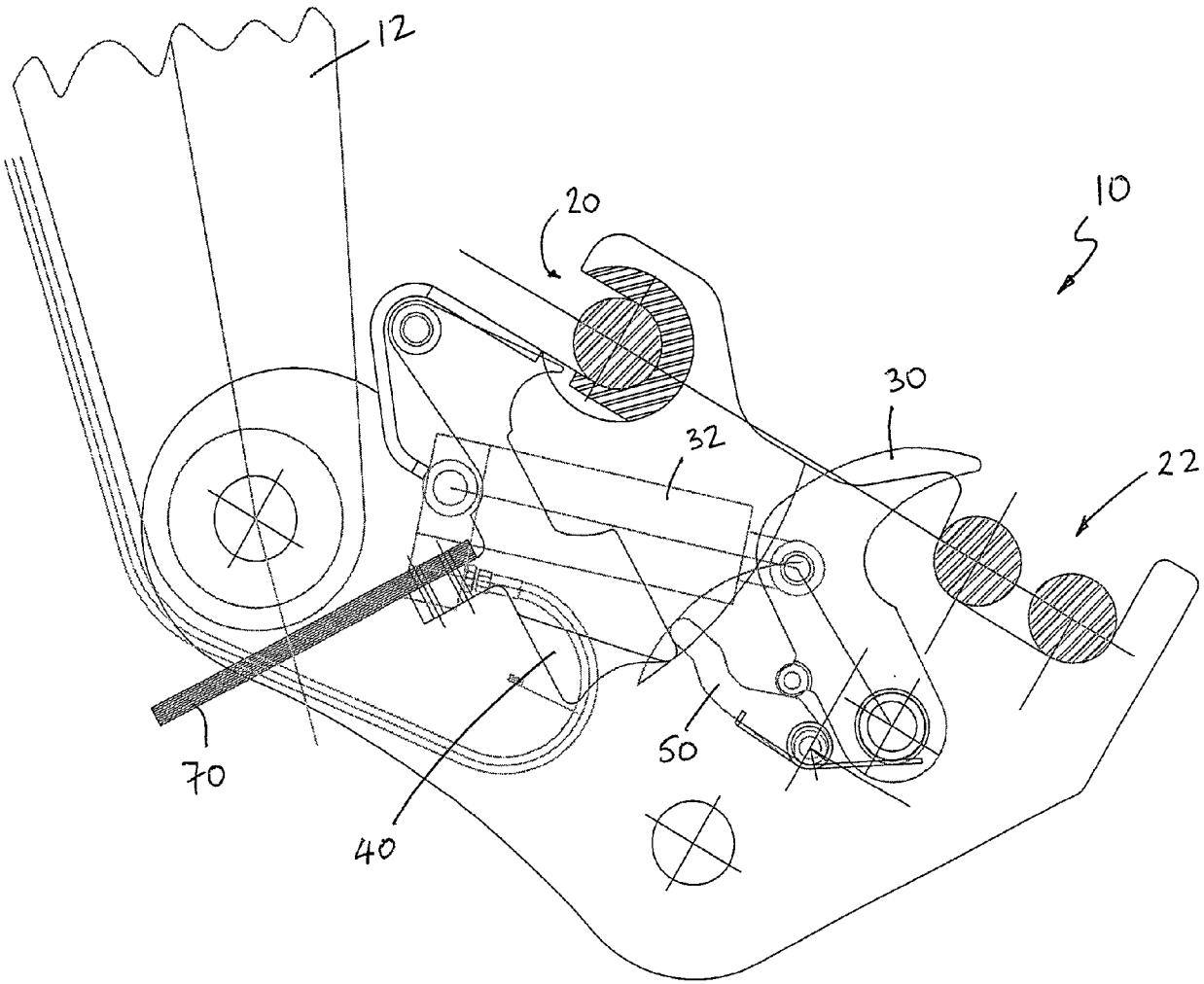
FIG. 6 is a cut-away side view of the coupler of FIG. 1 connected to an excavator arm, the arm and the coupler being shown in a first inverted, or overhead, orientation.

In order to disengage the attachment from the coupler 10, the latching hook 30 must at the outset be in its latching state as shown in, for example, FIG. 5. The coupler 10 is inverted (FIG. 6) by appropriate manoeuvring of the arm 12 until the blocking bar 40 falls under the influence of gravity to the non-blocking state. Subsequently, the latching hook 30 is retracted to its open state causing the lever 50 to hold the blocking bar 40 in its non-blocking state. The attachment may then be disengaged from the coupler 10.

Figure 7:
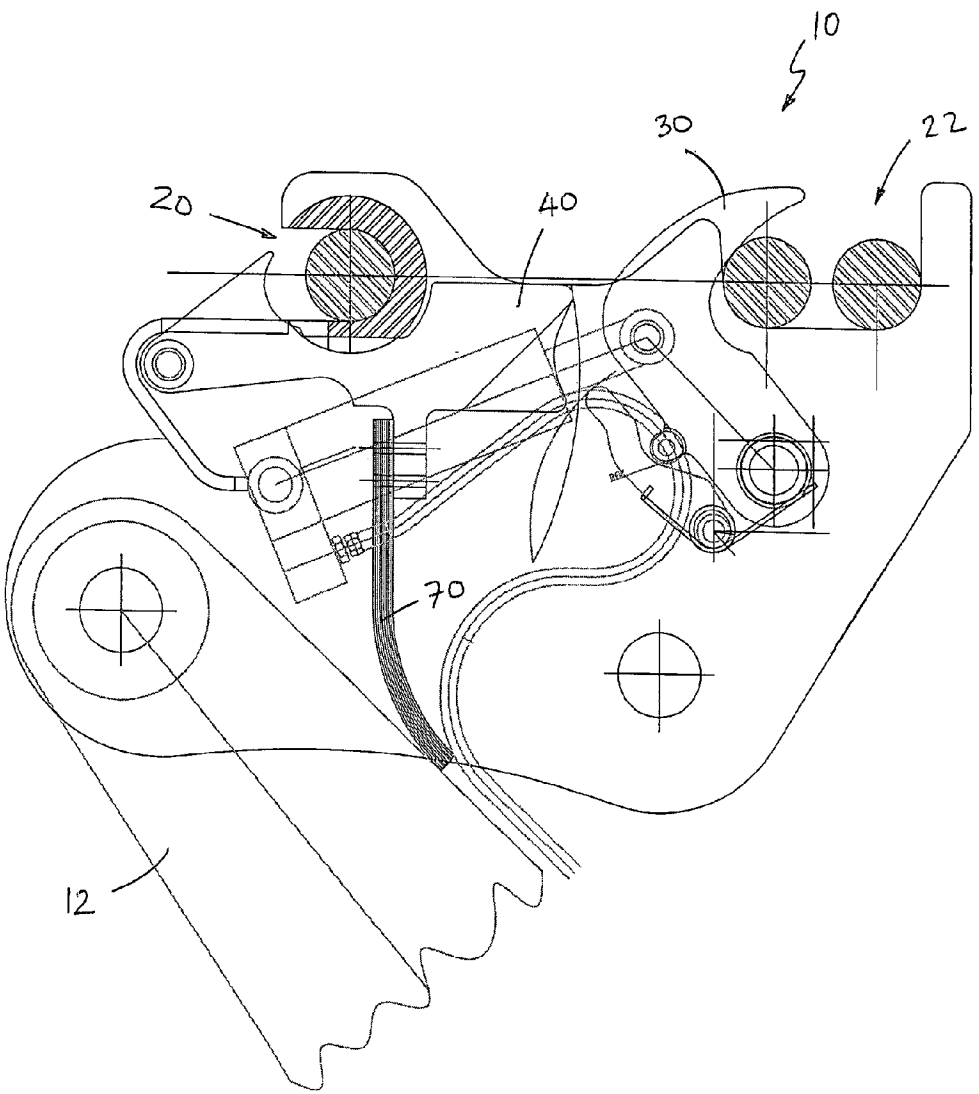
FIG. 7 is a cut-away side view of the coupler of FIG. 1 connected to an excavator arm, the arm and the coupler being shown in a second inverted, or overhead, orientation.

If it is desired to maintain the blocking bar 40 in its blocking state while the coupler 10 is inverted, this may be achieved by means of a biasing member 70 and appropriate manoeuvring of the arm 12 and coupler 10. In the preferred embodiment, the biasing member 70 comprises a leaf spring, or other elongate resilient and flexible member, and has one end fixed to, or engagable with, the blocking member 40. The arrangement is such that, by pivoting the coupler 10 with respect to the arm 12, the other end of the biasing member 70 may be caused to engage with the arm 12, the action of the arm 12 on the biasing member 70 causing the biasing member 70 to push the blocking bar 40 into the blocking state (FIG. 7). The biasing member 70 maintains the blocking bar 40 in the blocking state as long as the relative angular orientation between the coupler 10 and the arm 12 is maintained.

In FIG. 5, the coupler 10 is shown in a working orientation wherein the recesses 20, 22 face generally downwards, i.e. generally towards the ground. In contrast, in FIGS. 6 and 7 the coupler is inverted such that the recesses 20, 22 face generally upwardly, i.e. away from the ground. The orientation shown in FIG. 6 may be referred to as an upside down orientation wherein the relative angular orientation between the coupler and the arm 12 is such that the blocking bar 40 is able to fall, under gravity, out of the blocking position and is not prevented from doing so by interaction between the biasing member 70 and the arm 12. The orientation of FIG. 7 may be referred to the overhead orientation. In the overhead orientation, the relative angular relationship between the coupler 10 and the arm 12 is such that the interaction between the biasing member 70 and arm 12 hold the blocking bar 40 in its blocking position (unless the lever 50 is preventing it from doing so). Hence, the upside down orientation may be adopted when it is desired to disengage an attachment from the coupler 10, whereas the overhead orientation may be adopted if it is desired to work with the coupler in an inverted position.

In the foregoing description, it is described how the latching hook 30 is capable of holding the blocking bar 40 in its blocking state, as shown for example in FIG. 3. In preferred embodiments, however, the blocking bar may be held in its blocking state by the action of the pin 24 against the blocking bar 40 itself. This arrangement, which is described in more detail below, may act in conjunction with the action of the hook 30 against the blocking bar 40, or may serve to hold the blocking bar in its blocking state even when the latching hook 30 is not sufficiently retracted to prevent the blocking bar from leaving its blocking state. For example, if the coupler 10 is being used with an attachment having relatively wide pin spacings (e.g. the pins may be the pins 24, 26' shown on the drawings), then it will be seen that the latching hook 30 may withdraw to an extent where it allows the pin 26' to leave to recess 22, but not be sufficiently far retracted to interfere with the movement of the blocking bar 40.

In such an event, pin 26 may fall out of recess 22 and cause the attachment (not shown) to swing with respect of the coupler 10 about pin 24. This tends to cause pin 24 to engage with the jaw 44 of the blocking bar 40. The engagement of the pin 24 with the jaw 44, urges the blocking bar into its blocking state, or more particularly, has the effect of holding the blocking bar 40 in its blocking state. This is because the action of the pin 24 on the jaw 44 urges the blocking bar 40 to pivot about pivot point 42 in an anti-clockwise direction (as shown in FIG. 3). In the preferred embodiment, this is achieved by providing the jaw 44 with a curved surface (concave in the illustrated embodiment), the centre of the curved surface preferably being located between the centre of the pin 24 (when in the recess 20) and the pivot point 42 of the blocking bar 40 in a vertical direction as viewed in FIG. 2. It will be understood however that the jaw may take other shapes and configurations to the same effect.

Figure 8:
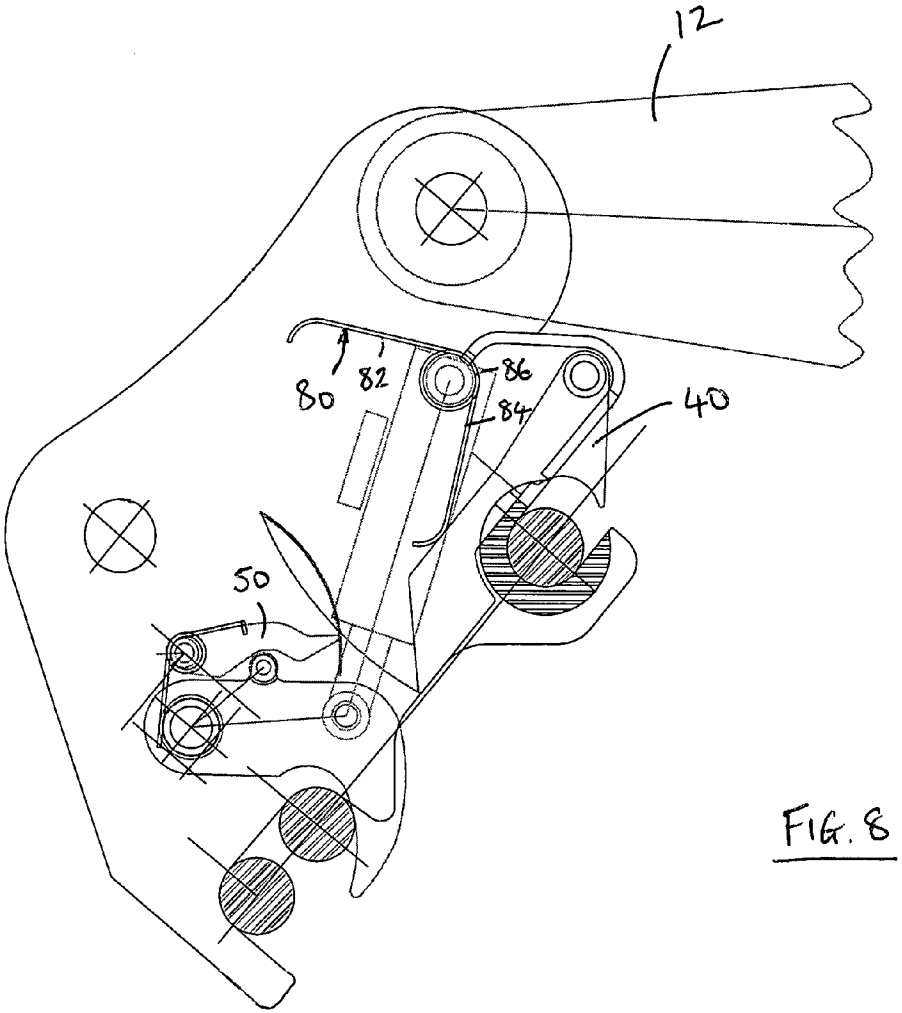
FIGS. 8 to 11 show an alternative embodiment of the coupler in respective different orientations.
Figure 9:
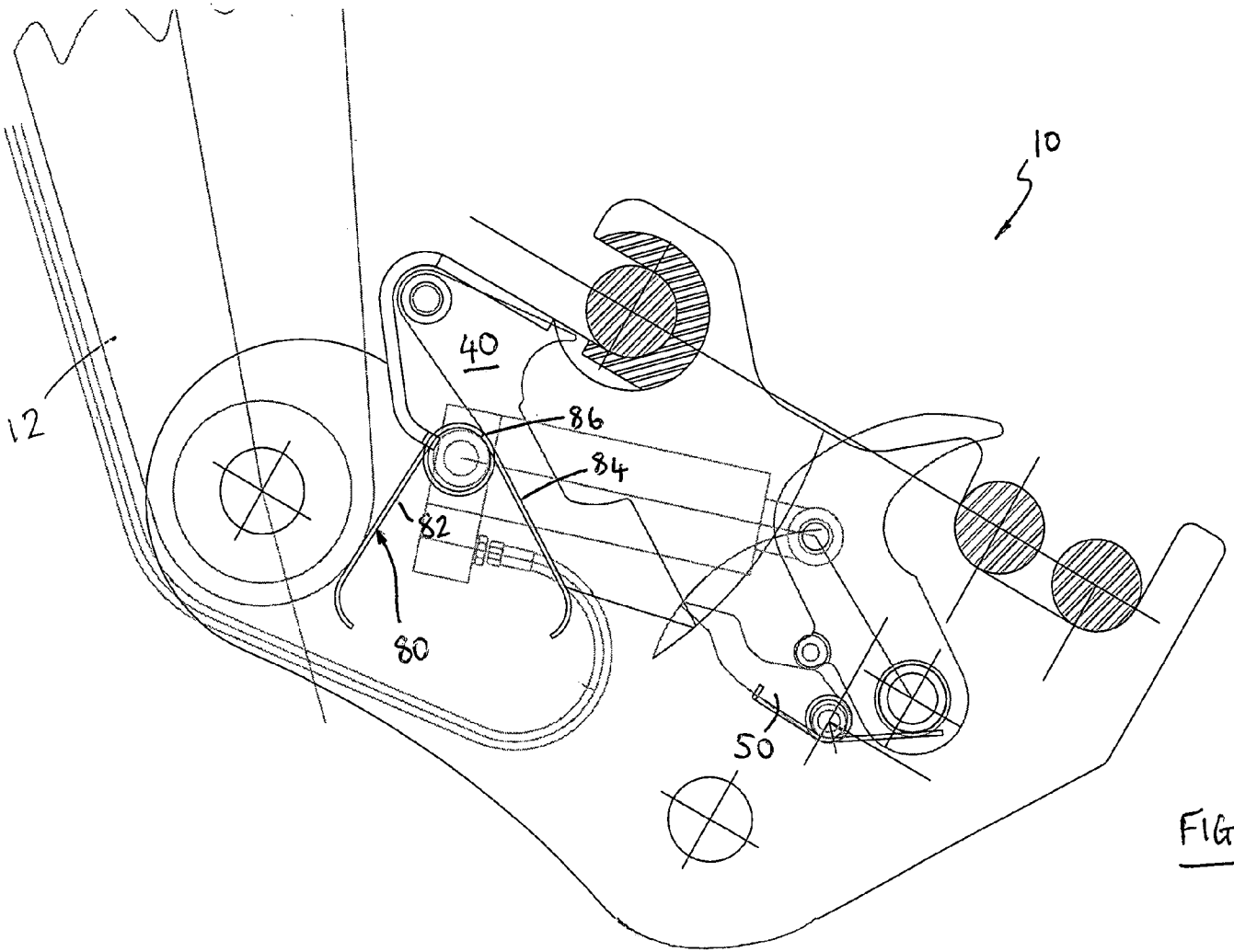
Figure 10:
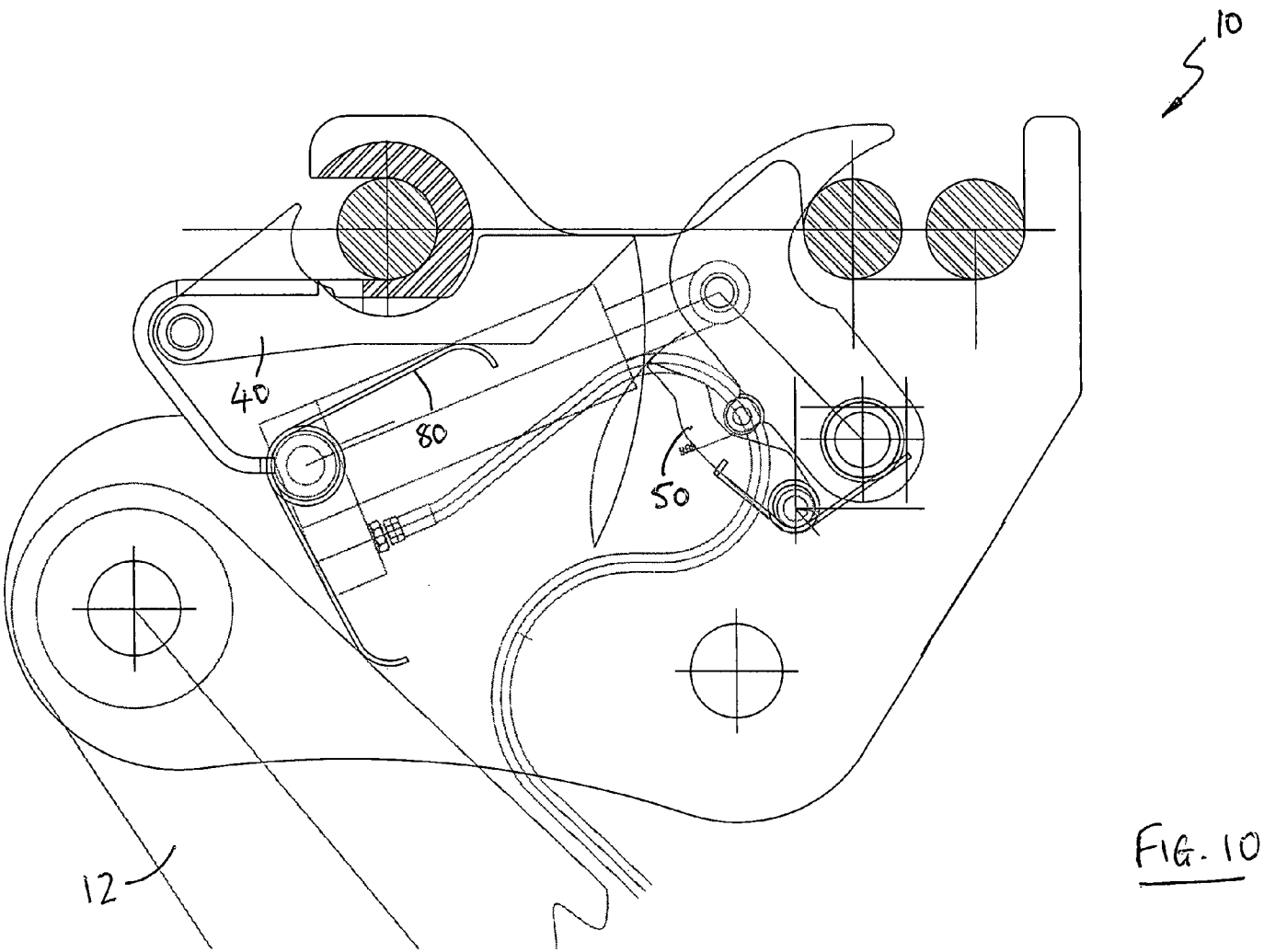
Figure 11:
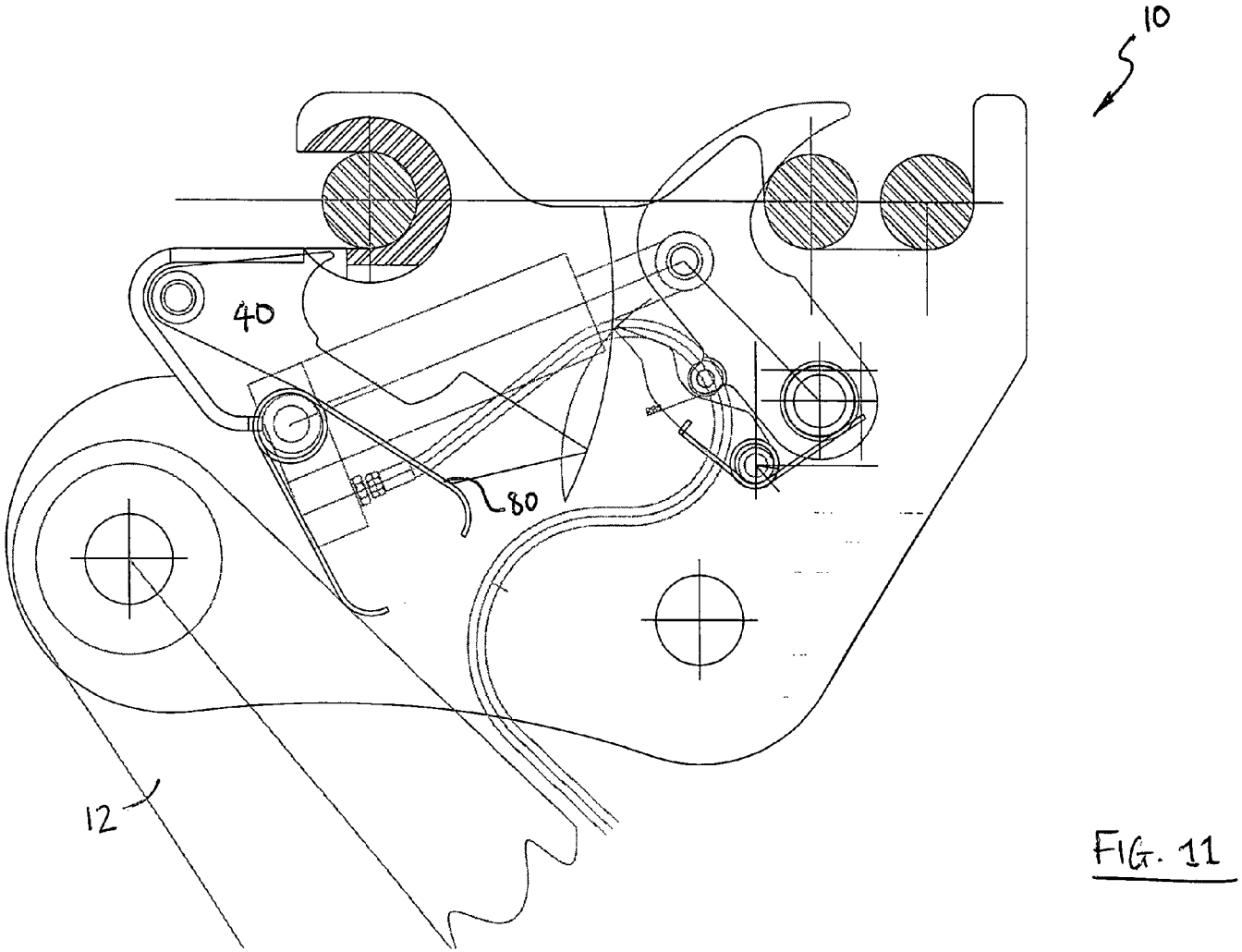

In an alternative embodiment (FIGS. 8 to 11), the leaf spring may be replaced by an alternative biasing member, such as a torsion spring 80, a compression spring, or other resilient biasing member arranged between the blocking bar 40 and the arm 12. In the case of a torsion spring, the spring 80 may comprise two legs 82, 84 and a coil portion 86, the coil portion 86, for example, being mounted on the body at or around the end 34 of the ram 32, one leg being arranged for engagement with the blocking bar, the other being arranged to engage with the arm 12 when the coupler adopts the position of FIG. 7 or 11. FIGS. 8 to 11 illustrate the action of the spring 80 under four different orientations of the coupler. In FIG. 8, the coupler is shown in a normal working orientation and the torsion spring 80 is not in contact with the dipper arm 12. In FIG. 9, the coupler is inverted (e.g. corresponding to the upside down orientation of FIG. 6) to allow the blocking bar 40 to fall out of its blocking state under gravity. In FIG. 10, the coupler is in an overhead position in which the torsion spring 80 acts between the arm and bar 40 to hold the blocking bar 40 in its blocking state. In FIG. 11, the coupler is in an overhead position in which the spring 80 is in a compressed state since the lever 50 holds the blocking bar in its blocking position.

Alternatively still, one or more powered actuators (not shown), e.g. hydraulic, pneumatic or electric actuators, may be provided for actuating the blocking bar 40 between its blocking and non-blocking states, or at least from one of said states to the other. In such an embodiment, the lever 50 and the biasing member 70 are not required. The actuator(s) may be operated in any convenient manner, e.g. by separate controls in the cab of the excavator or other machine.

In FIGS. 12 to 16 a further alternative embodiment is shown, in which the biasing member 170 preferably comprises a leaf spring, or other elongate resilient and flexible member, and has one end connected or coupled to the blocking bar 40 and having an angled or bent portion 171 at its other end. The angled portion 171 is arranged so that it extends from the remainder of the biasing member 170 in a direction towards the arm 12 when the coupler is in its overhead position.

Figure 12:
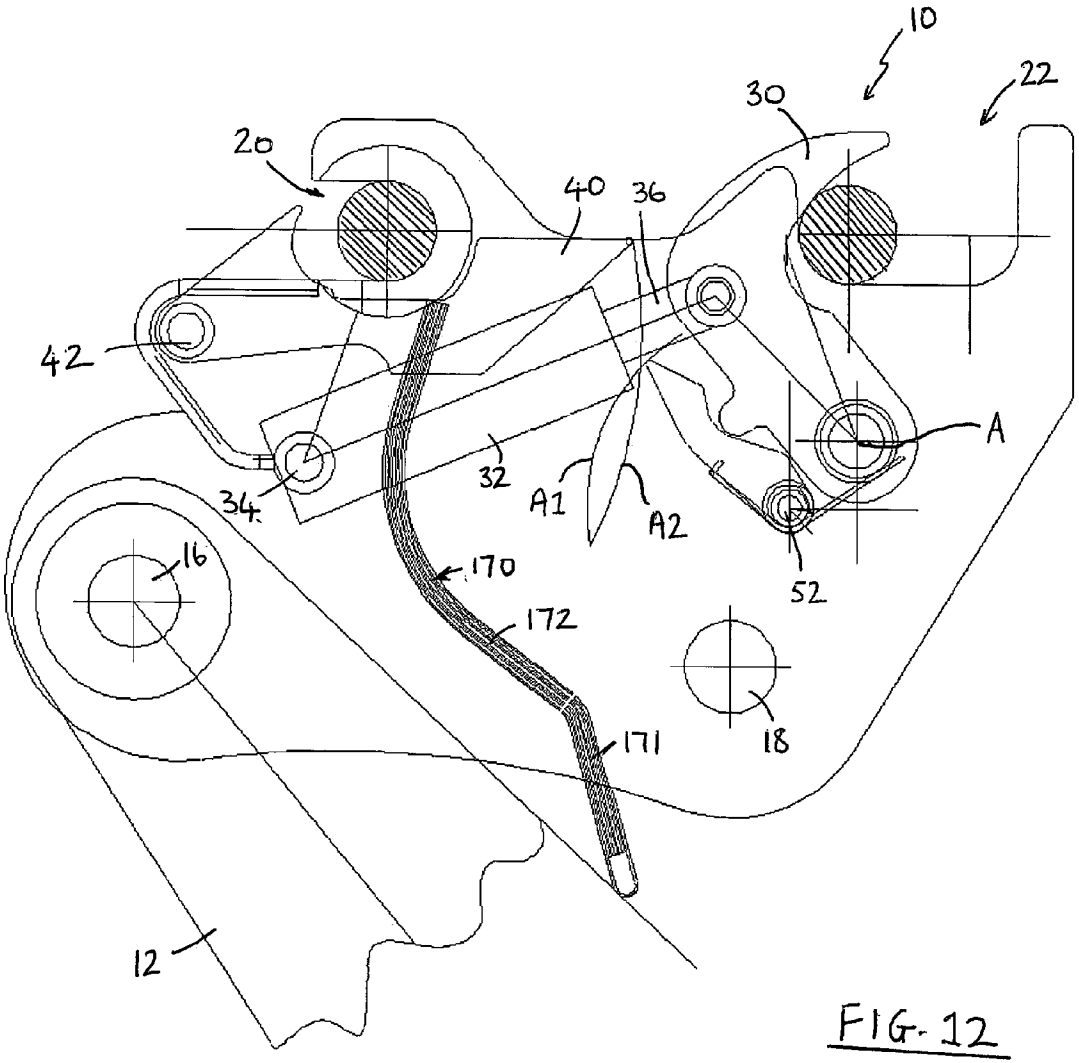
FIGS. 12 to 16 show a further alternative embodiment of the coupler wherein the biasing means includes a bent portion.

The biasing member 170 has a body portion 172 connected or coupled to the blocking bar 40 at one end, and the angled or crank portion 171 at the other end. The crank portion 171 extends obliquely from the body portion 172 in a direction generally towards the arm 12 when the coupler 10 is in the overhead position (FIG. 12). The arrangement is such that, when the coupler 10 is in the overhead position (e.g. as shown in FIG. 12) the end of the biasing member 170 engages with the arm 12 and the action of the arm 12 on the biasing member 170 causes the biasing member 170 to urge the blocking bar 40 into the blocking state. The shape of the biasing member 170 generates extra force when compared to the biasing member 70 and so provides extra support when holding the blocking bar 40 in the blocking state.

Figure 14:
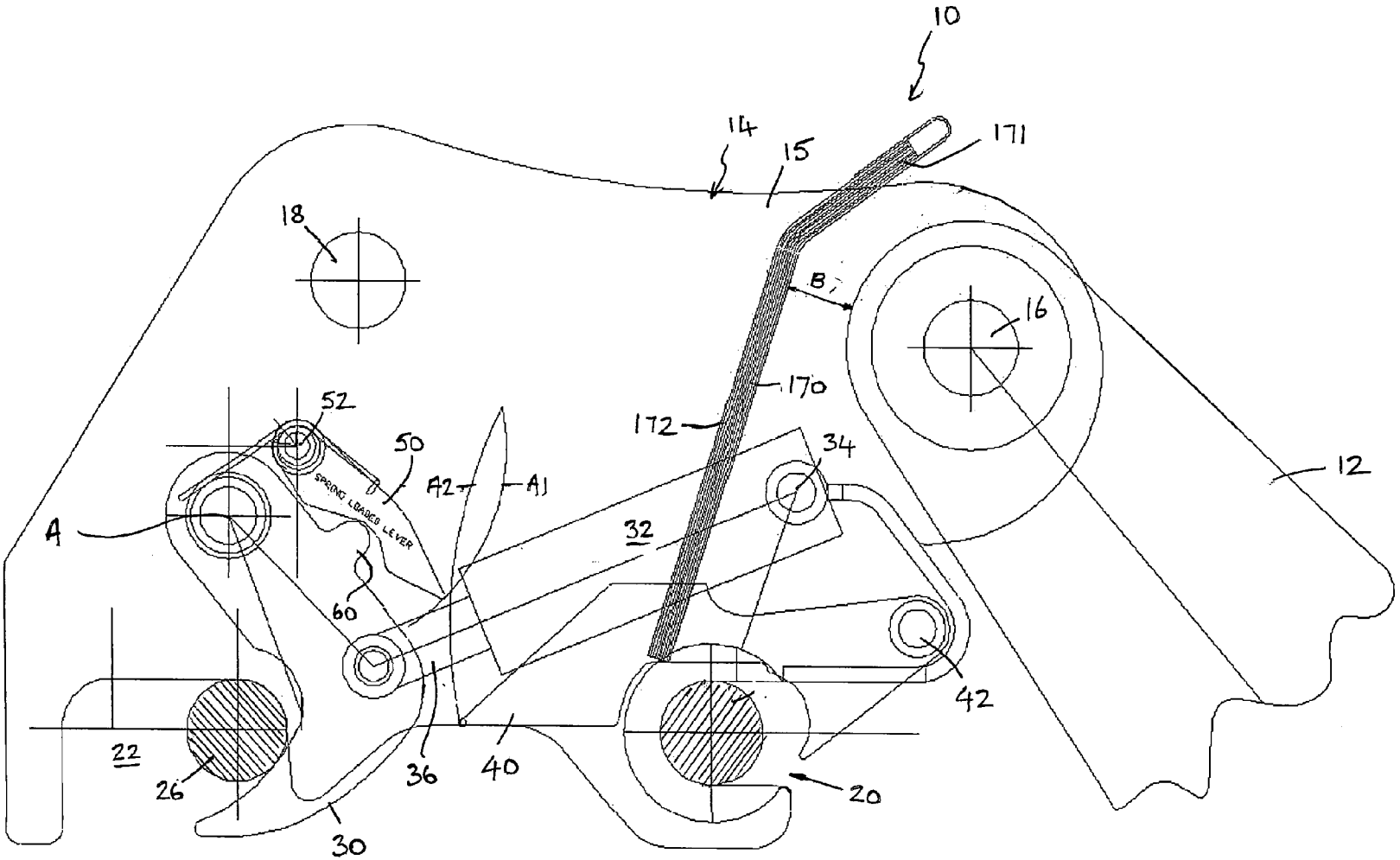
Figure 15:
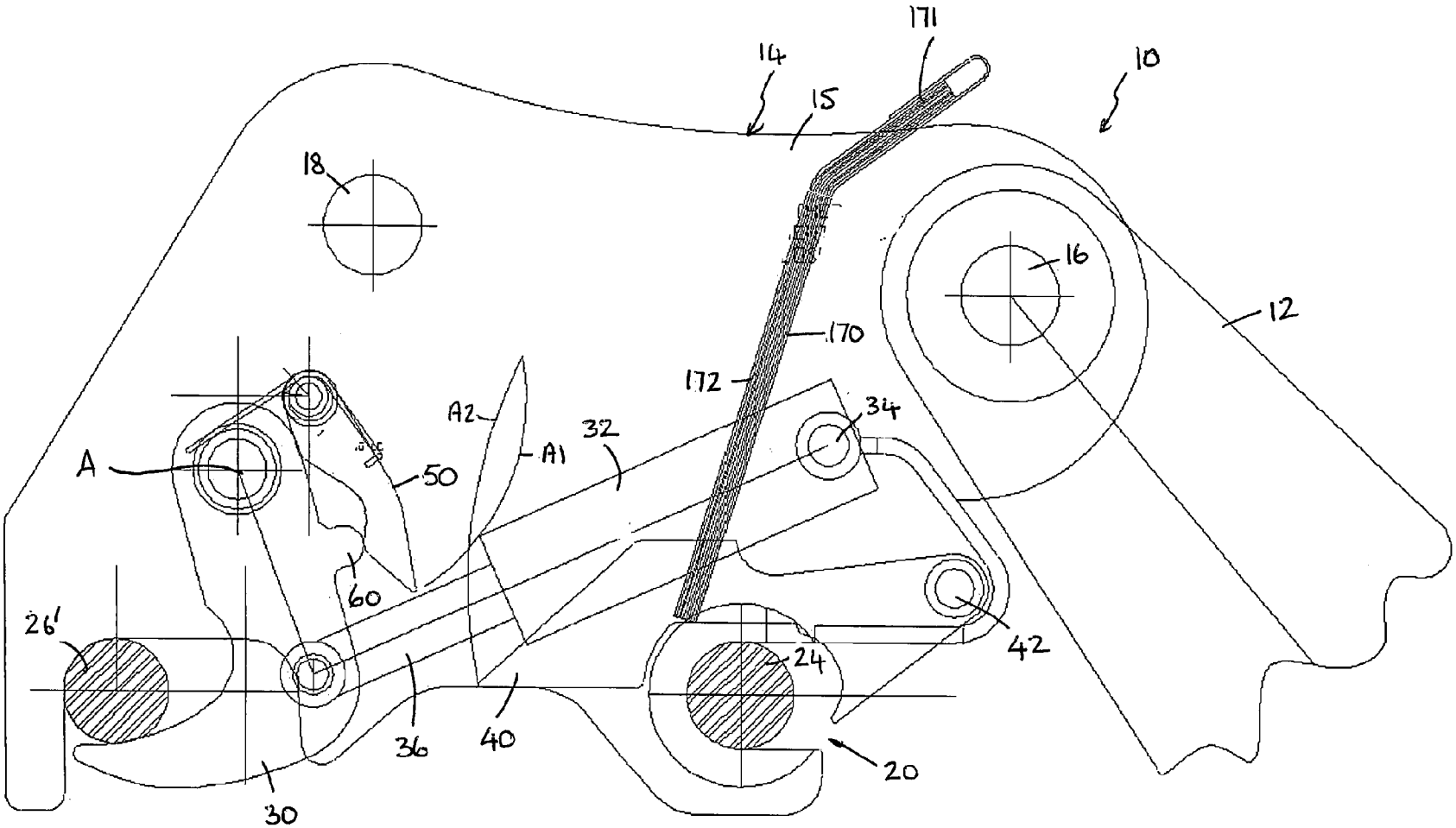
Figure 16:
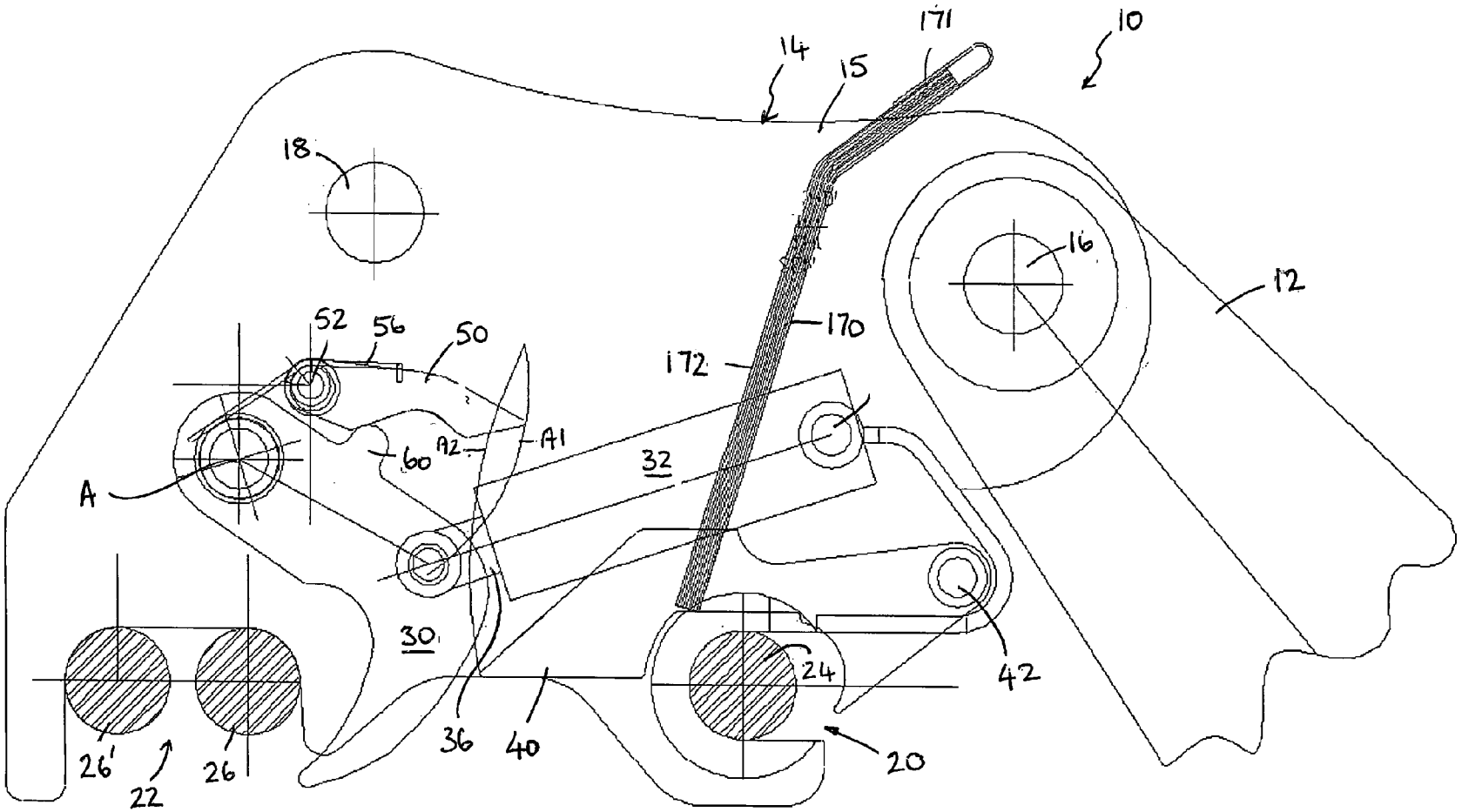

In the preferred arrangement, the biasing member 170 and arm 12 are arranged so that there is a gap (indicated as B in FIG. 14) between the biasing member 170 and arm 12 during use when the biasing member 70 is not engaged with the arm 12 (FIGS. 14 to 16). The gap B allows the blocking bar 40 to move from its blocking state to its non-blocking state without interference by interaction of the biasing member 170 and arm 12.

It will be apparent that the couplers 10 may operate substantially in the same manner as described with reference to FIGS. 1 to 7.

Figure 13:
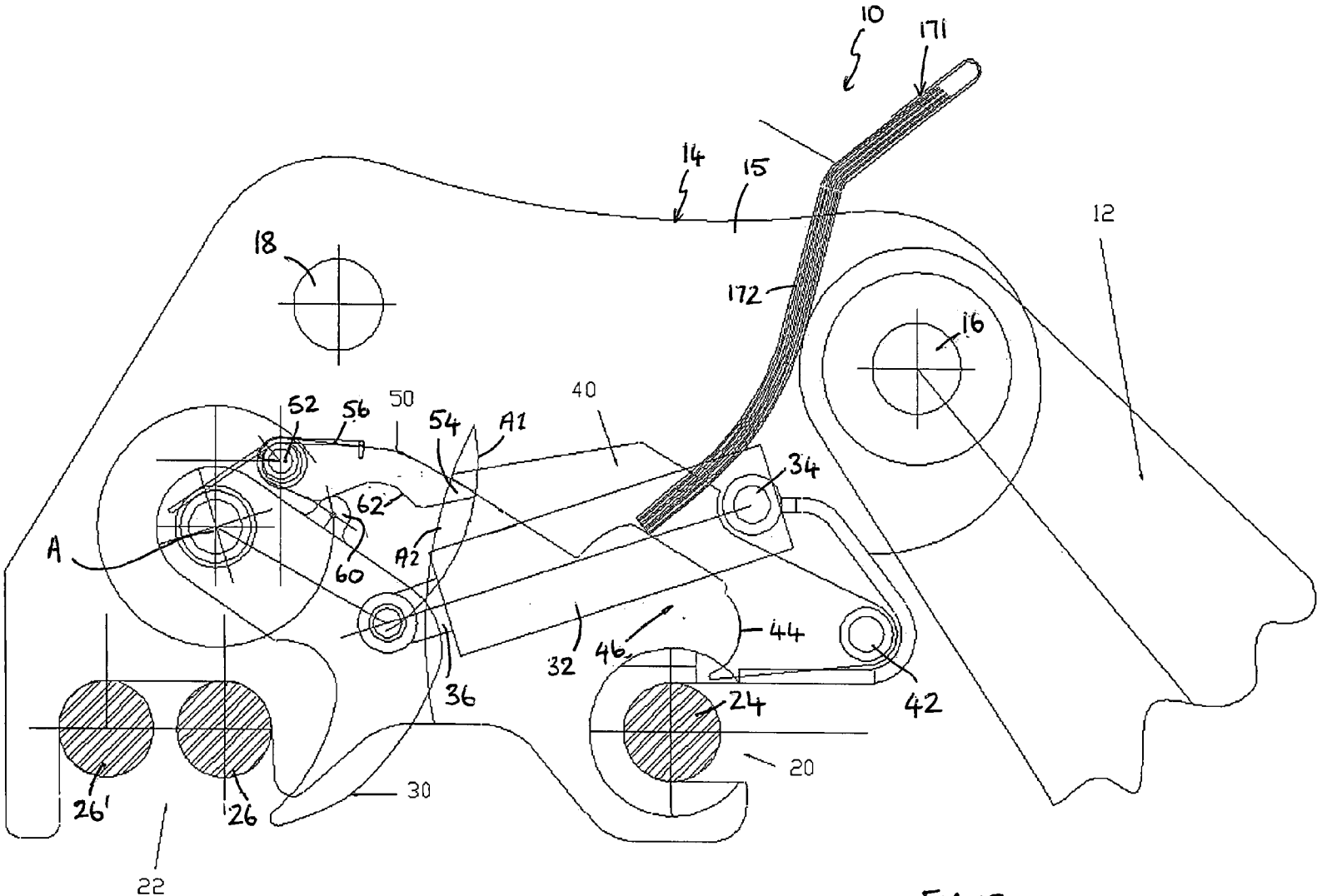

It will be seen that in the configuration of FIG. 13, the body portion 172 of the biasing member 170 engages with the arm 12, whereas in the configuration of FIG. 12, the bent portion 171 engages with the arm 12.

Figure 17:
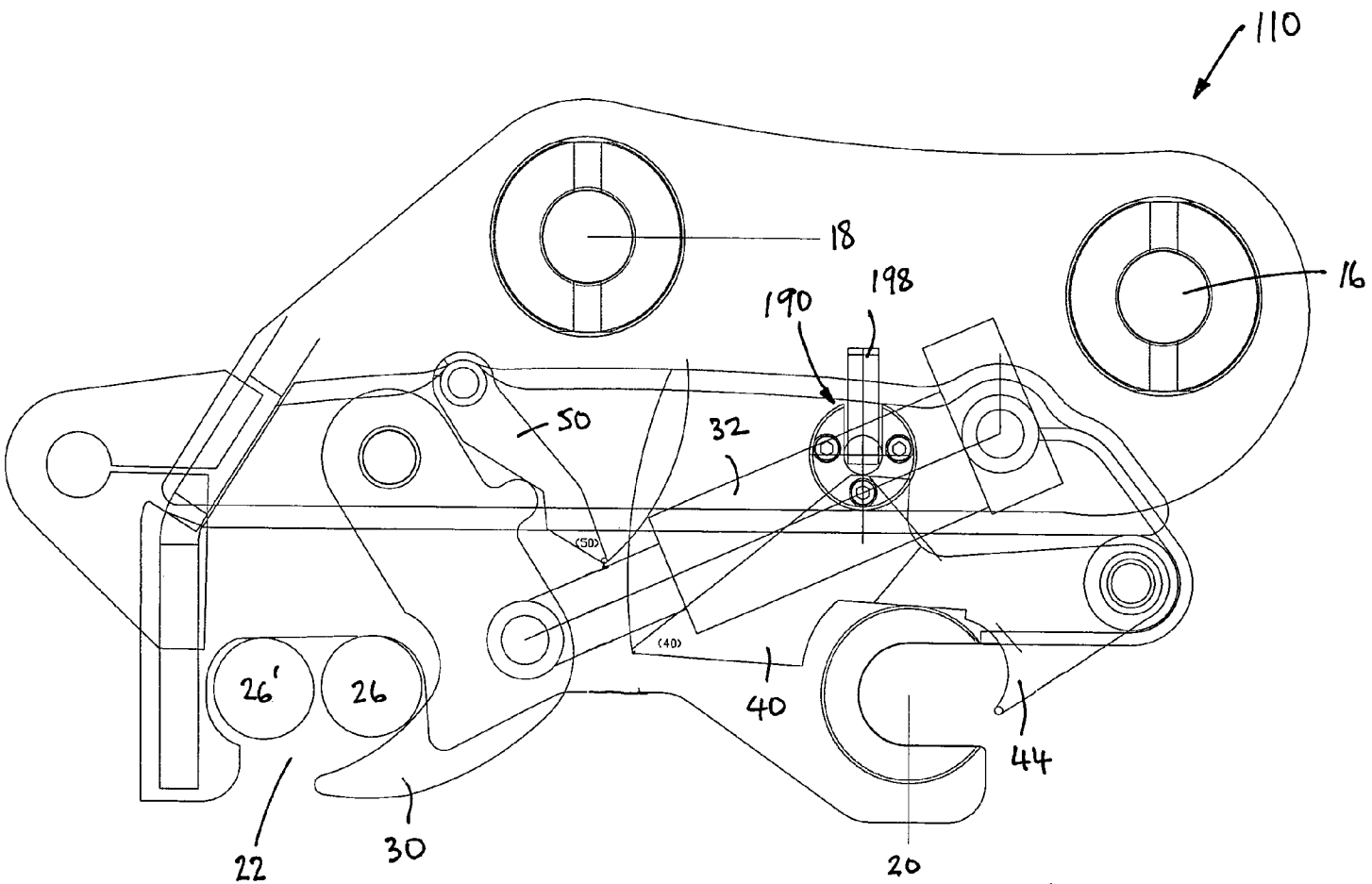
FIG. 17 is a cut-away side view of a still further alternative embodiment including a safety locking pin.
Figure 18:
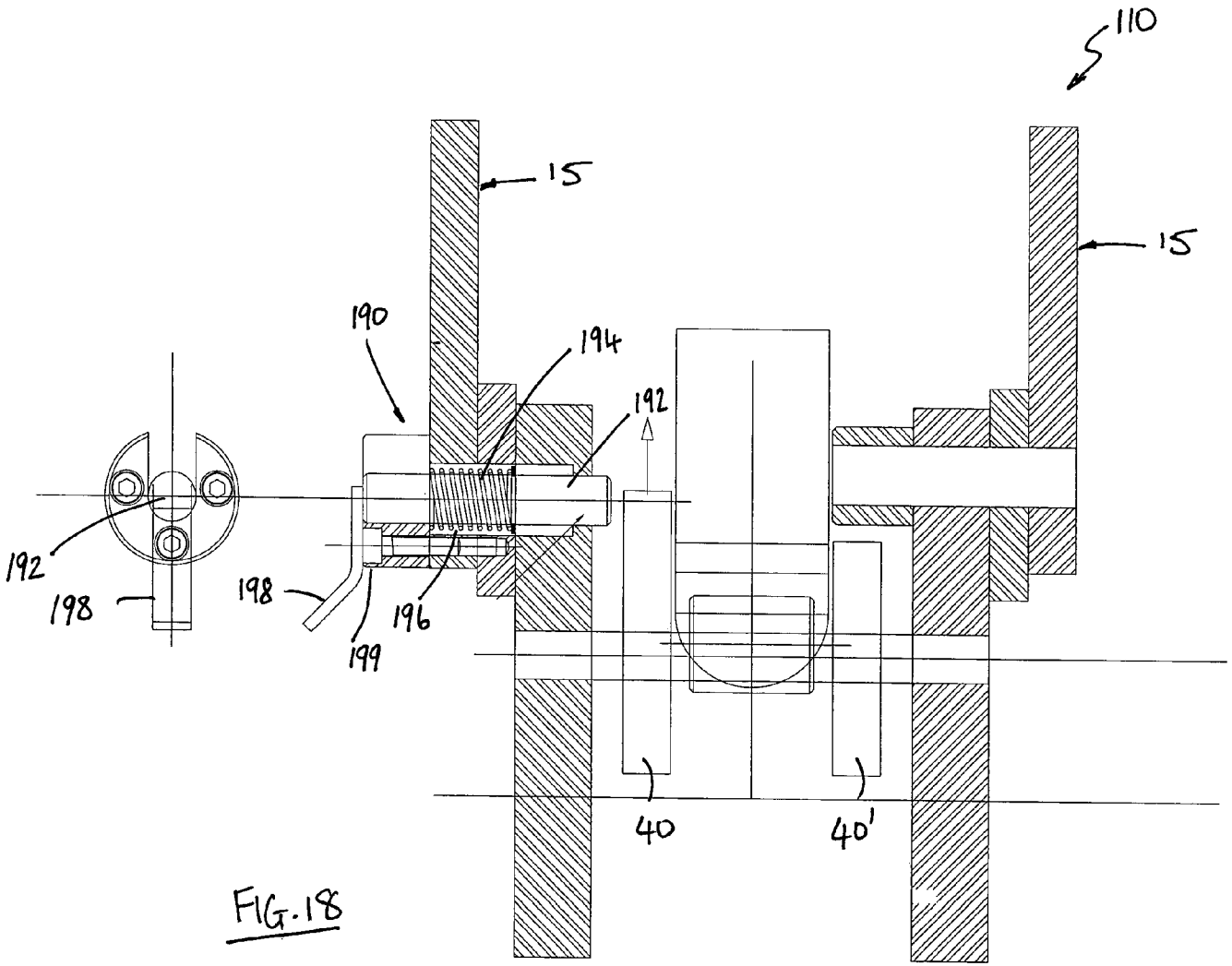
FIG. 18 is a sectional end view of the coupler FIG. 17 showing the safety pin in a retracted state.
Figure 19:
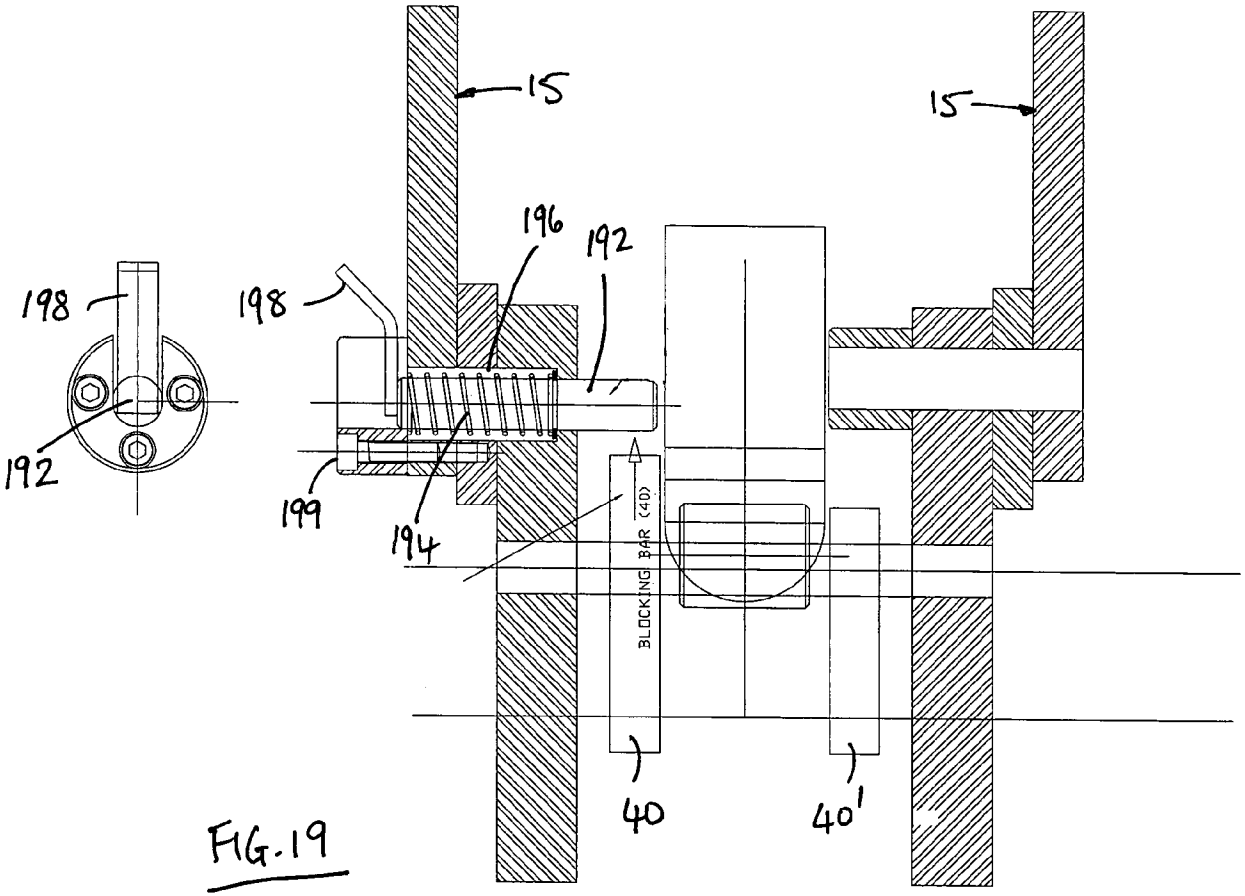
FIG. 19 is a sectional view of the coupler FIG. 17 showing the pin in an engaged state.

Referring now to FIGS. 17 to 19, there is shown a still further embodiment of a coupler 110 which is similar to the couplers 10 described in FIGS. 1 to 16 and respect of which similar descriptions apply as will be apparent to those skilled in the art. The coupler 110 includes a locking mechanism in the preferred form of a safety pin device 190 comprising a safety pin 192 moveable between a retracted state (FIG. 18) and an engaged state (FIG. 19). The pin 192 is preferably resiliently biased, e.g. by means of a compression spring 194, to adopt the engaged state. The safety pin device 190 is mounted on the body of the coupler 110 and is positioned so that, when the pin 192 is in the engaged state, it lies in the path of the blocking bar 40 in order to prevent the blocking bar 40 from leaving its blocking state.

The pin 192 is slideably located in a channel 196 formed in the body of the coupler 110. The channel 196 also retains the spring 194. Conveniently, the pin 192 is provided with a handle 198. As shown in FIG. 18, the handle 198 may be rotated about the axis of the pin 192 and to engage with an abutment 199 to lock the pin 192 in its retracted state against the bias of the spring 194. When the handle is rotated out of engagement of the abutment 199 and released, the action of the spring urges the pin 192 into its engaged state (FIG. 19).

It will be apparent that the location of the safety pin device 190 determines the amount by which the blocking bar 40 may move away from its normal blocking state. At the very least, the safety pin device 190 should be positioned so that the blocking bar 40 is not able to move out of its blocking state to the extent that its tip can be lifted by the tip of the lever 50.

It will be understood that in any or all of the aforementioned embodiments, the latching hook 30 may be comprised of one or more hooks, and the blocking bar 40 may be comprised of one or more blocking bars (see FIGS. 18 and 19 where two spaced apart blocking bars 40, 40′ are shown, each co-operating with the recess 20). In the case where there are two or more components to either the latching hook or the blocking bar, the respective components may or may not be connected together. Typically, they are connected together and move as a respective unit and so may be considered as a single latching hook or a single blocking bar even though it may be comprised of two or more spaced apart components.

The invention is not limited to the embodiments described herein which may be modified or varied without departing from the scope of the invention.

The invention claimed is:

1. A coupler for an excavator, the coupler comprising:

a body having first and second recesses for receiving first and second pins, respectively, of an attachment;

a power operated latching hook mounted on the body and movable into and out of a latching state in which it prevents the second pin from being removed from said second recess; and a blocking bar mounted on the body and movable into and out of a blocking state in which the blocking bar prevents the first pin from being removed from the first recess, wherein said latching hook and said blocking bar are separate from one another such that said latching hook is capable of movement into and out of the latching state, said movement being independent of movement of said blocking bar, and wherein said latching hook and said blocking bar are configured so that, with the latching hook in said latching state, said blocking bar is movable independently of movement of said latching hook, and wherein, said latching hook and said blocking bar are configured so that, with said blocking bar in said blocking state, upon movement of the latching hook out of the latching state, the latching hook is engagable with the blocking bar to retain the blocking bar in the blocking state.

2. A coupler as claimed in claim 1, wherein said blocking bar is pivotably mounted to the body at a pivot point, said first recess being located between said latching hook and said pivot point.

3. A coupler as claimed in claim 2, wherein said pivot point is located at a first end of said blocking bar, the blocking bar being shaped and dimensioned such that its other end lies in the path of the latching hook when in the blocking state.

4. A coupler as claimed in claim 2, wherein said blocking bar is pivotable about said pivot point under the influence of gravity.

5. A coupler as claimed in claim 2, wherein said blocking bar is actuatable between said blocking and non-blocking states by means of at least one powered actuator.

6. A coupler as claimed in claim 1, wherein the blocking bar includes a portion for preventing the first pin from being removed from the first recess, said portion of the blocking bar being provided by a jaw or recess.

7. A coupler as claimed in claim 6, wherein said blocking bar is pivotably mounted to the body at a pivot point, said first recess being located substantially between said latching hook and said pivot point, and wherein said jaw or recess is located between said pivot point and a free end of the blocking bar.

8. A coupler as claimed in claim 7, wherein said free end is engagable with the latching hook.

9. A coupler as claimed in claim 1, further including a lever movable into and out of a holding state in which it is capable of holding the blocking bar out of the blocking state.

10. A coupler as claimed in claim 9, wherein the lever is coupled to the latching hook to move into the holding state when the latching hook is moved out of the latching state and to move out of the holding state when the latching hook moves into the latching state.

11. A coupler as claimed in claim 9, wherein the lever is mounted on the body behind the latching hook with respect to said second recess.

12. A coupler as claimed in claim 9, further including means for resiliently biasing said lever into contact with the latching hook.

13. A coupler as claimed in claim 9, wherein the latching hook carries a cam and the lever includes a cooperating cam surface, the cam being arranged to ride along the cam surface as the latching hook moves into and out of its latching state, the cam surface being shaped to cause an angle of inclination between the latching hook and the lever to increase as the latching hook moves out of the latching state and to decrease as the latching hook moves into the latching state.

14. A coupler as claimed in claim 1, further including means for biasing said blocking bar into its blocking state, the biasing means being coupled to the blocking bar and arranged to engage with an excavator arm to which the coupler is attached during use depending on the relative orientation of the coupler and the arm, wherein in at least a first relative orientation of the coupler and the arm, the biasing means is held under tension between the arm and the blocking bar and urges the blocking bar into its blocking state.

15. A coupler as claimed in claim 14, wherein the biasing means comprises a leaf spring, a torsion spring or other resilient biasing member.

16. A coupler as claimed in claim 14, wherein the biasing means comprises a biasing member having a body with a bent portion that is bent with respect to the body and arranged for engagement with the excavator arm in said at least first relative orientation of the coupler and arm.

17. A coupler as claimed in claim 16, wherein said bent portion is bent towards said arm in said at least first relative orientation of the coupler and arm.

18. A coupler as claimed in claim 1, wherein the blocking bar includes a portion shaped so that, when engaged in use by an attachment pin contained within said first recess, action of said attachment pin on said portion urges said blocking bar into its blocking state.

19. A coupler as claimed in claim 18, wherein said portion of the blocking bar is shaped to present a concave curved surface to said first recess when the blocking bar is in said blocking state.

20. A coupler as claimed in claim 1, wherein, when said blocking bar is in said blocking state and said latching hook is in said latching state, said blocking bar prevents said latching hook from moving out of said latching state.

21. A coupler as claimed in claim 1, wherein said latching hook is pivotably mounted on said body.

22. A coupler as claimed in claim 1, wherein said latching hook and said blocking bar are configured so that, with said blocking bar out of said blocking state, upon movement of said latching hook away from said latching state, the latching hook is engagable with the blocking bar to retain the blocking bar out of the blocking state.

23. A coupler as claimed in claim 22, wherein said latching hook is engagable with the blocking bar to retain the blocking bar in the blocking state when said latching hook is in a fully open position.

24. A coupler for an excavator, the coupler comprising:

a body having first and second recesses for receiving first and second pins, respectively, of an attachment;

a power operated latching hook mounted on the body and movable into and out of a latching state in which it prevents the second pin from being removed from said second recess; and a blocking bar mounted on the body and movable into and out of a blocking state in which the blocking bar prevents the first pin from being removed from the first recess, wherein said latching hook and said blocking bar are separate from one another such that said latching hook is capable of movement into and out of the latching state, said movement being independent of movement of said blocking bar, and wherein said latching hook and said blocking bar are configured so that, with the latching hook in said latching state, said blocking bar is movable independently of movement of said latching hook, and wherein said latching hook and said blocking bar are configured so that, with said blocking bar out of said blocking state, upon movement of said latching hook away from said latching state, the latching hook is engagable with the blocking bar to retain the blocking bar out of the blocking state.

25. A coupler as claimed in claim 24, wherein said latching hook and said blocking bar are configured so that, with said blocking bar in said blocking state, upon movement of the latching hook away from the latching state, the latching hook is engagable with the blocking bar to retain the blocking bar in the blocking state.

26. A coupler as claimed in claim 24, wherein said latching hook is engagable with the blocking bar to retain the blocking bar in the blocking state when said latching hook is in a fully open position.

* * * * *